US008869657B2

(12) United States Patent
Matar

(10) Patent No.: US 8,869,657 B2
(45) Date of Patent: Oct. 28, 2014

(54) SCREWDRIVER HANDLE WITH MULTIPLE CAPTIVE BITS

(76) Inventor: Mohamad Matar, Downey, CA (US)

( * ) Notice: Subject to any disclaimer, the term of this patent is extended or adjusted under 35 U.S.C. 154(b) by 232 days.

(21) Appl. No.: 13/604,624

(22) Filed: Sep. 6, 2012

(65) Prior Publication Data

US 2013/0068074 A1 Mar. 21, 2013

Related U.S. Application Data

(60) Provisional application No. 61/626,100, filed on Sep. 21, 2011.

(51) Int. Cl.
*B25G 1/08* (2006.01)

(52) U.S. Cl.
CPC ..... *B25G 1/085* (2013.01)
USPC ..... 81/177.4; 81/439

(58) Field of Classification Search
CPC ..... B25G 1/08; B25G 1/085; B25B 15/02
USPC ..... 81/177.4, 439, 490
See application file for complete search history.

(56) References Cited

U.S. PATENT DOCUMENTS

| | | | | |
|---|---|---|---|---|
| 6,332,384 | B1 * | 12/2001 | Cluthe | 81/490 |
| 7,275,466 | B2 * | 10/2007 | Cluthe | 81/439 |
| 8,752,456 | B1 * | 6/2014 | Turnbo | 81/439 |
| 2002/0007705 | A1 * | 1/2002 | Beauchamp | 81/490 |
| 2005/0045002 | A1 * | 3/2005 | Cluthe | 81/177.85 |
| 2007/0277654 | A1 * | 12/2007 | Beauchamp | 81/439 |
| 2010/0242689 | A1 * | 9/2010 | Cluthe | 81/439 |

* cited by examiner

*Primary Examiner* — David B Thomas
(74) *Attorney, Agent, or Firm* — Kenneth L. Green

(57) ABSTRACT

A driver handle includes stored bits and passages to retain the bits during a transition from storage to use. A rod extends from the rear of each bit and an enlarged bulb is formed on the end of each rod. The passages provide passage of the bulb and a narrow slot reaching from the passage to the exterior of the driver handle allowing passage of the rod. The bits are thus movably retained in the driver handle and may be withdrawn while leaving the bulb in the handle. The bit is then moved to a shaft extending from the handle for use and the bulb slides through the passage without escaping from the driver handle preventing the bit from being separated from the driver handle and being misplaced.

14 Claims, 4 Drawing Sheets

SCREWDRIVER HANDLE WITH MULTIPLE CAPTIVE BITS

The present application claims the priority of U.S. Patent Application Ser. No. 61/626,100 filed Sep. 21, 2011, which application is incorporated in its entirety herein by reference.

BACKGROUND OF THE INVENTION

The present invention relates to tools for tightening and loosening threaded fasteners and in particular to handles accepting various bits for different fasteners.

There are a wide variety of fasteners which are commonly encountered during construction, manufacturing, repair, and maintenance of mechanical devices, homes, vehicles, and the like. These fasteners require various bit types and sizes. For example, the required bits may be slotted bits, phillips bits, hex bits, torx bits, square drive bits, and a variety of special purpose bits, and each type of bit may be one of several sizes.

Driver sets often include a driver handle and a selection of bits which attaches to the handle for use. The bits may be separately stored, or stored on or in the driver handle. In each instance, the bits are independently detached from the stored position and attached to the end of a driver shaft extending from the driver handle for use. It is common to use several different bits in a short time on a single task, and a user often removes a bit from the driver shaft and places it in a nearby location for future use. Unfortunately, it is also common to forget where a bit was placed, thus requiring the user to search for the bit when it is again needed.

BRIEF SUMMARY OF THE INVENTION

The present invention addresses the above and other needs by providing a driver handle which includes stored bits and passages to retain the bits during a transition from storage to use. A rod extends from the rear of each bit and an enlarged bulb is formed on the end of each rod. The passages provide passage of the bulb and a narrow slot reaching from the passage to the exterior of the driver handle allowing passage of the rod. The bits are thus movably retained in the driver handle and may be withdrawn while leaving the bulb in the handle. The bit is then moved to a shaft extending from the handle for use and the bulb slides through the passage without escaping from the driver handle preventing the bit from being separated from the driver handle and being misplaced.

In accordance with one aspect of the invention, there is provided a driver handle with storage for a multiplicity of bits. Each bit may be withdrawn from its storage location and moved to a bit holder for use without freeing the bit from the driver handle.

In accordance with one aspect of the invention, there is provided a tool including at least one bit, a handle, and a shaft extending from an end of the handle. The bit includes a bit head having an engaging feature for turning a fastener and having a non-round cross-section, a rod extending from the bit head opposite to the engaging feature, and an enlarged bulb end of the rod opposite the bit head and having a greater cross-section than the rod. The handle is configured for gripping by a user and includes a handle surface, bit pockets for receiving the bits, handle passages running inside the handle and having a handle passage cross-section allowing passage of the enlarged end of the rod, and handle slots reaching out from the handle passages to the handle surface and having a width greater than the diameter of the rod and smaller than the cross-section of the enlarged bulb end of the rod. The shaft includes a shaft recess in a bit end of the shaft opposite the handle for receiving the bits for use, a longitudinal shaft passage through the shaft having a shaft cross-section allowing passage of the enlarged end of the rod, and a shaft slot through one side of the shaft reaching to the shaft passage and having a width greater than the diameter of the rod and smaller than the cross-section of the enlarged end of the rod. The shaft recess is configured to receive the head of the bit and shaped to prevent rotation of the bit with respect to the shaft. The handle passages connect to the shaft passage and the handle slots connect to the shaft slot to provide passage of the bit rod along the slots and the enlarged bulb end of the bit along the passages allowing the bit to be moved from a stored position in the bit pocket to a use position in the shaft recess.

In accordance with another aspect of the invention, there is provided a tool including the bits held captive to the tool by enlarged ends of bits retained in passages in a tool handle and tool shaft. A slot reaches between the passages and an outside surface of the handle and shaft. The bits are moved from storage in bit pockets of the handle, to a recess in the end of the tool shaft for use, by moving the enlarged ends of bits along the passages and rods connecting the enlarged ends of bits to heads of the bits along the slots.

In accordance with yet another aspect of the invention, there is provided a tool including bits retained in a shaft recess by magnets residing in the shaft, or by an interference fit of the bits to the shaft recess, or by an interference fit of the bit with a plastic insert in the shaft recess.

In accordance with still another aspect of the invention, there is provided a tool including the bits retained in the bit pockets by magnets residing in the handle, or by an interference fit of the bits to the pockets, or by lips reaching inward along an outer edge of the bit pockets, or by a sliding handle cover which slides over the bit pockets.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
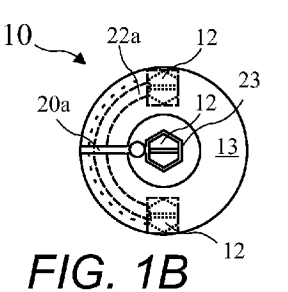
FIG. 1B is a first end view of the tool according to the present invention.
Figure 1A:
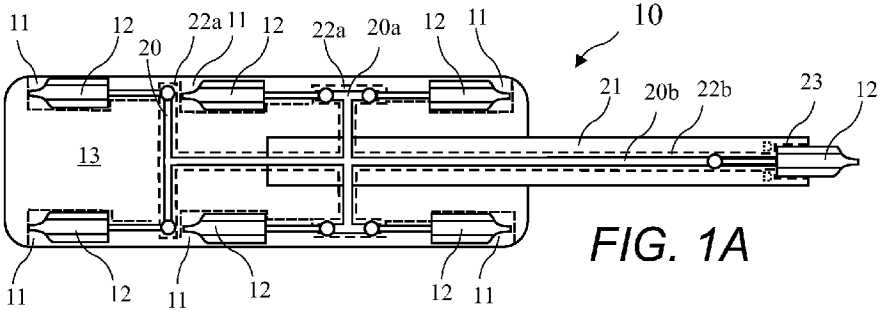
FIG. 1A is a top view of a tool according to the present invention.
Figure 1D:
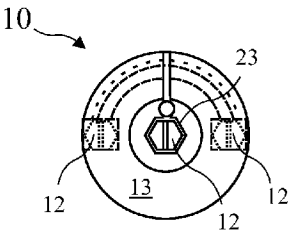
FIG. 1D is a second end view of the tool according to the present invention.
Figure 1C:
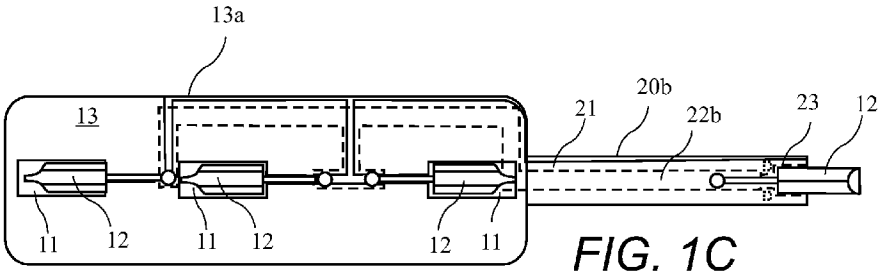
FIG. 1C is a side view of the tool according to the present invention.

A top view of a tool 10 according to the present invention is shown in FIG. 1A, a first end view of the tool 10 is shown in FIG. 1B, a side view of the tool 10 is shown in FIG. 1C, and a second end view of the tool 10 is shown in FIG. 1D. The tool 10 includes a handle 13 and a shaft 21. The handle 13 allows a user to comfortably and firmly grasp and turn the tool 10. The shaft 21 extends from the handle 13 and includes a shaft recess 23. A bit 12 is slidable into the shaft recess 23 to place the bit 12 in position for use, to engage a fastener to turn the fastener, to tighten or loosen the fastener. The bit 12 and the recess 23 have cooperating non-round cross-sectional shapes to prevent the bit 12 from rotating in the recess 23 to enable the tool 10 to turn fasteners (e.g., screws, nuts, and the like) to tighten and loosen the fasteners.

Figure 2B:
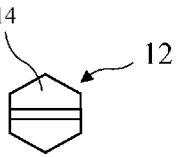
FIG. 2B is a front end view of the bit according to the present invention.
Figure 2A:
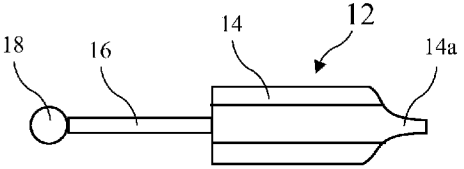
FIG. 2A is a side view of a bit according to the present invention.
Figure 2C:
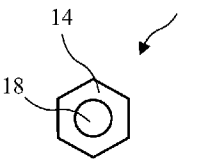
FIG. 2C is a rear end view of the bit according to the present invention.
Figure 3A:
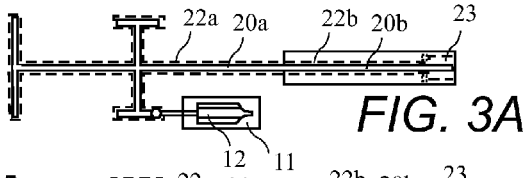
FIG. 3A is a top view of the bit residing in a bit pocket of a tool handle according to the present invention.
Figure 3B:
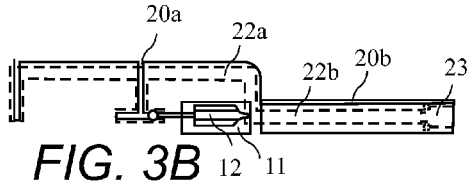
FIG. 3B is a side view of the bit residing in the bit pocket of the handle according to the present invention.
Figure 4A:
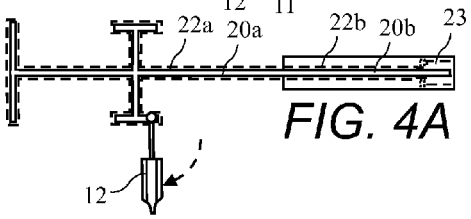
FIG. 4A is a top view of the bit rotated out of the bit pocket of the handle according to the present invention.
Figure 4B:
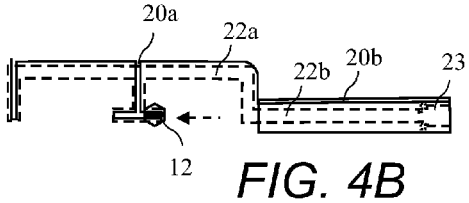
FIG. 4B is a side view of the bit rotated out of the bit pocket of the handle according to the present invention.
Figure 5A:
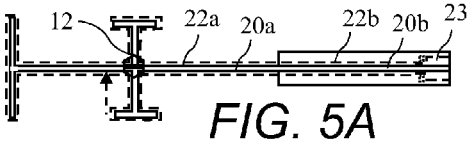
FIG. 5A is a top view of the bit translated along a lateral slot of the handle according to the present invention.
Figure 5B:
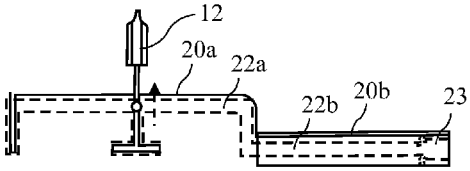
FIG. 5B is a side view of the bit translated along a lateral slot of the handle according to the present invention.
Figure 6A:
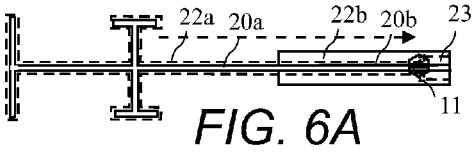
FIG. 6A is a top view of the bit translated along longitudinal slots of the handle and shaft according to the present invention.
Figure 6B:
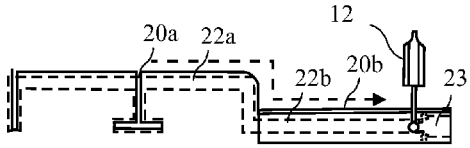
FIG. 6B is a side view of the bit translated along the longitudinal slots of the handle and shaft according to the present invention.
Figure 7A:
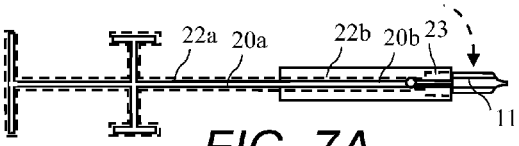
FIG. 7A is a top view of the bit rotated to align with a recess in the end of the shaft according to the present invention.
Figure 7B:
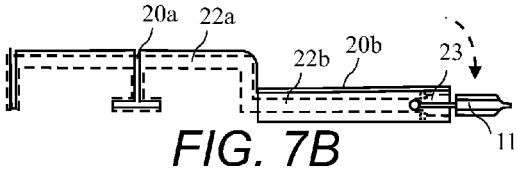
FIG. 7B is a side view of the bit rotated to align with the recess in the end of the shaft according to the present invention
Figure 8A:
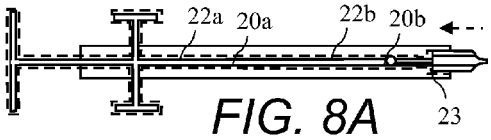
FIG. 8A is a top view of the bit residing in the recess in the end of the shaft according to the present invention.
Figure 8B:
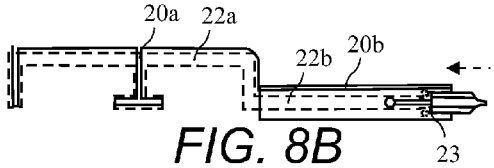
FIG. 8B is a side view of the bit residing in the recess in the end of the shaft according to the present invention.

A side view of the bit 12 according to the present invention is shown in FIG. 2A, a front end view of the bit 12 is shown in FIG. 2B, and a rear end view of the bit 12 is shown in FIG. 2C. The bit 12 includes a head 14 having an engaging feature 14*a*, a rod portion 16 extending from the head 14 opposite to the engaging feature 14*a*, and an enlarged end 18 of the rod 16 opposite the head 14. The engaging portion 14*a* is configured to mate with a Philips head fastener, a slot head fastener, a hex head fastener, a twelve point fastener, a socket head (i.e., Allen head), a torx head fastener, a square drive fastener, or any fastener, either nut (female threads) or bolt (male threads) type fastener which is rotated to tighten or loosen. The bit head 14 has a non-round cross-section and preferably a hexagonal cross-section commonly found on similar bits, the cross-section cooperating with the cross-section of the shaft recess 23 to prevent rotation of the bit 12 within the recess 23. The enlarged end 18 has a greater cross-section than the rod 16. The bit 12 cooperates with the handle 13 and shaft 23 to prevent the bit 12 from escaping from the tool 10, and thereby prevents misplacing or loss of the small bits 12. The rod portion 16 may have round, square, oval, hexagonal, or any cross-section, but is preferably round cross-section. The enlarged end 18 may be any shape, but is preferably spherical.

The bit 12 resides in a bit pocket 11 in the handle 13 when not in use. Handle passages 22*a* run inside the handle 13 and have a cross-section allowing passage of the enlarged end 18 of the rod 16, and handle slots 20*a* reaching out from the handle passages 22*a* to the handle surface 13*a* and having a width greater than the diameter of the rod 16 and smaller than the cross-section of the enlarged end 18 of the rod 16. The shaft 21 includes a shaft recess 23 in a bit end of the shaft 21 opposite the handle 13, a longitudinal shaft passage 22*b* through the shaft 21 having a passage cross-section allowing passage of the enlarged end 18 of the rod 16, and a shaft slot 20*b* reaching through one side of the shaft 21 into the shaft passage 22*b* having a width greater than the diameter of the rod 16 and smaller than the cross-section of the enlarged end 18 of the rod 16. The recess 23 is configured to receive the head 14 of the bit 12 and shaped to prevent rotation of the bit 12 with respect to the shaft 21. The handle passages 22*a* connect to the shaft passage 22*b* and the handle slots 20*a* connect to the shaft slot 20*b* to provide passage of the rod 16 of the bit 12 along the slots 20*a* and 20*b* and the enlarged end 18 of the bit 12 along the passages 22*a* and 22*b* allowing the bit 12 to be moved from a stored position in the bit pocket 11 to a use position in the shaft recess 23.

The relocation of the bit 12 from a bit pocket 11 to the recess is depicted in FIG. 3A-8B. The bit 12 is shown residing in a bit pocket 11 of the tool handle 13 in FIGS. 3A and 3B. The bit 12 is shown rotated out of the bit pocket 11 of the handle 13 in FIGS. 4A and 4B. The bit 12 is shown translated along a lateral slot 20*a* of the handle in FIGS. 5A and 5B. The bit 12 is shown translated along longitudinal slots 20*a* of the handle and 20*b* of the shaft in FIGS. 6A and 6B. The bit 12 is shown rotated to align with a recess 23 in the end of the shaft 13 in FIGS. 7A and 7B. The bit 12 is shown residing in the recess 23 in the end of the shaft 13 in FIGS. 8A and 8B.

Figure 9:
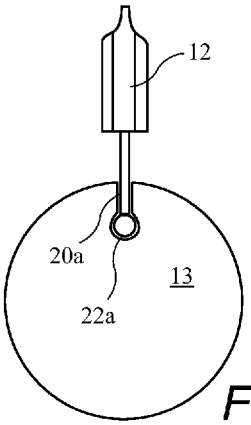
FIG. 9 shows the bit with an enlarged end held captive in a handle passage according to the present invention.

FIG. 9 shows the bit with the enlarged end 18 held captive in the handle passage 22*a* and the rod 16 reaching through the handle 13 through slot 20*a*. The passages and slots allow the bit 12 to be moved from storage in the bit pocket 11 to use in the shaft recess 23.

Figure 10A:
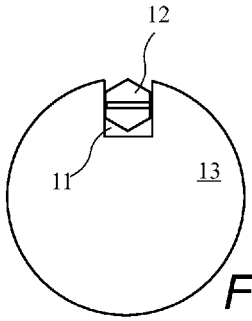
FIG. 10A shows the bit held in the bit pocket by an interference fit according to the present invention.

FIG. 10A shows the bit 12 held in the bit pocket 11 by an interference fit with the bit pocket 11.

Figure 10B:
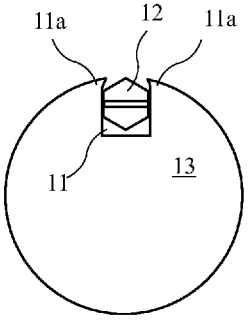
FIG. 10B shows the bit held in the bit pocket by lips along top edges of the bit pocket according to the present invention.

FIG. 10B shows the bit 12 held in the bit pocket 11 by lips 11*a* along top edges of the bit pocket 11.

Figure 10C:
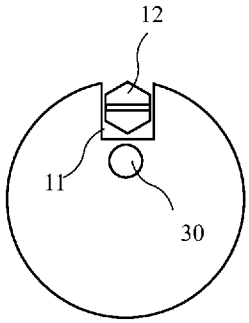
FIG. 10C shows the bit held in the bit pocket by a magnet according to the present invention.

FIG. 10C shows the bit 12 held in the bit pocket 11 by a magnet 30.

Figure 10D:
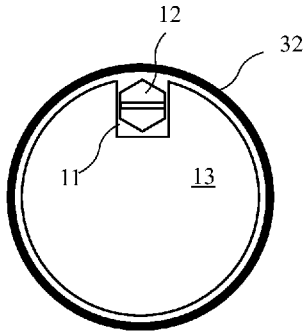
FIG. 10D shows the bit held in the bit pocket by an axially sliding sleeve according to the present invention.
Figure 10E:
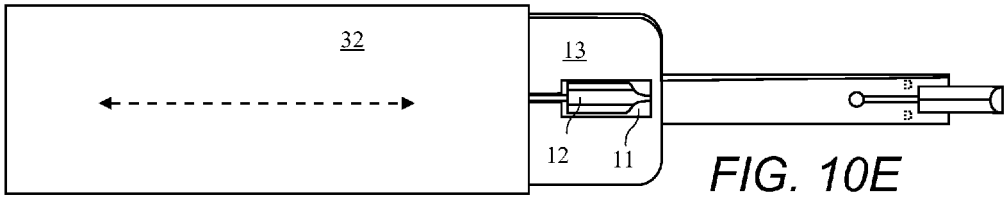
FIG. 10E shows a side view of the bit held in the bit pocket by the axially sliding sleeve 32.

FIG. 10D shows the bit 12 held in the bit pocket 11 by an axially sliding sleeve 32, and FIG. 10E shows a side view of the bit 12 held in the bit pocket 11 by the axially sliding sleeve 32.

Figure 11A:
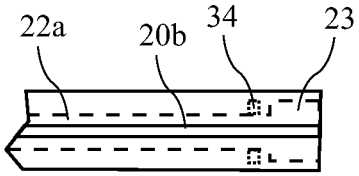
FIG. 11A shows a magnet proximal to the shaft recess for holding the bit in the shaft recess according to the present invention.
Figure 11B:
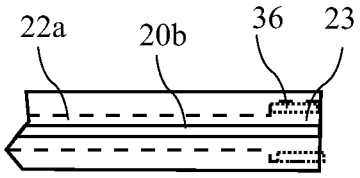
FIG. 11B shows an insert in the shaft recess providing an interference fit for holding the bit in the shaft recess according to the present invention.

FIG. 11A shows a magnet 34 proximal to the shaft recess 23 for holding the bit 12 in the shaft recess 23 and FIG. 11B shows an insert 36 in the shaft recess 23 providing an interference fit for holding the bit 12 in the shaft recess FIG. 11A shows a magnet proximal to the shaft recess for holding the bit in the shaft recess according to the present invention.

FIG. 11 B shows an insert in the shaft recess providing an interference fit for holding the bit in the shaft recess according to the present invention 23.

While the invention herein disclosed has been described by means of specific embodiments and applications thereof, numerous modifications and variations could be made thereto by those skilled in the art without departing from the scope of the invention set forth in the claims.

I claim:

1. A driver tool comprising:

at least one bit comprising:

a bit head having an engaging feature for turning a fastener and having a non-round cross-section;

a rod extending from the head opposite to the engaging feature; and an enlarged end of the rod opposite the head and having a greater cross-section than the rod;

a handle configured for gripping by a user, the handle including:

a handle surface;

bit pockets reaching into the handle surface for receiving the at least one bit;

handle passages running inside the handle and having a cross-section allowing passage of the enlarged end of the rod; and handle slots reaching out from the handle passages to the handle surface and having a width greater than the diameter of the rod and smaller than the cross-section of the enlarged end of the rod;

a shaft extending from an end of the handle, the shaft comprising:

a shaft recess in a bit end of the shaft opposite the handle, the recess configured to receive the bit head and shaped to prevent rotation of the bit with respect to the shaft;

a longitudinal shaft passage through the shaft having a shaft passage cross-section allowing passage of the enlarged end of the rod; and a shaft slot through one side of the shaft reaching to the shaft passage and having a width greater than the diameter of the rod and smaller than the cross-section of the enlarged end of the rod, wherein the handle passages connect to the shaft passage and the handle slots connect to the shaft slot to provide passage of the bit rod along the slots and the enlarged end of the bit along the passages allowing the bit to be moved from a stored position in the bit pocket to a use position in the shaft recess.

2. The driver tool of claim 1, wherein the handle is generally cylindrical.

3. The driver tool of claim 1, wherein the bits are retained in the bit pockets by magnets residing in the handle.

4. The driver tool of claim 1, wherein the bits are retained in the bit pockets by an interference fit of the bits to the pockets.

5. The driver tool of claim 1, wherein the bits are retained in the bit pockets by lips reaching inward along an outer edge of the bit pockets.

6. The driver tool of claim 1, wherein the bits are retained in the bit pockets by a sliding handle cover which slides over the bit pockets.

7. The driver tool of claim 1, wherein the enlarged ends of the rods are spherical ends.

8. The driver tool of claim 1, wherein the bit heads have a first hexagonal cross-section and the shaft recess has a second hexagonal cross-section slightly greater that the first hexagonal cross-section allowing the bit to be inserted into the shaft prevented from rotating with respect to the shaft.

9. The driver tool of claim 1, wherein the at least one bit comprises at least four bits.

10. The driver tool of claim 9, wherein the at least one bit comprises six bits.

11. The driver tool of claim 1, wherein the bits are retained in the shaft recess by magnets residing in the shaft.

12. The driver tool of claim 1, wherein the bits are retained in the shaft recess by an interference fit of the bits to the shaft recess.

13. The driver tool of claim 12, wherein the bits are retained in the shaft recess by an interference fit of the bit with a plastic insert in the shaft recess.

14. A driver tool comprising:

at least one bit comprising:

a bit head having an engaging feature for turning a fastener and having a hexagonal cross-section;

a round rod extending from the head opposite to the engaging feature; and an enlarged spherical end of the rod opposite the head and having a greater cross-section than the rod;

a handle configured for gripping by a user, the handle including:

a handle surface;

bit pockets reaching into the handle surface for receiving the at least one bit;

handle passages running inside the handle and having a cross-section allowing passage of the enlarged end of the rod; and handle slots reaching out from the handle passages to the handle surface and having a width greater than the diameter of the rod and smaller than the cross-section of the enlarged end of the rod;

a shaft extending from an end of the handle, the shaft comprising:

a shaft recess in a bit end of the shaft opposite the handle and having a hexagonal cross-section, the recess configured to receive the bit head and shaped to prevent rotation of the bit with respect to the shaft;

a longitudinal shaft passage through the shaft having a shaft passage cross-section allowing passage of the enlarged end of the rod; and a shaft slot through one side of the shaft reaching to the shaft passage and having a width greater than the diameter of the rod and smaller than the cross-section of the enlarged end of the rod, wherein the handle passages connect to the shaft passage and the handle slots connect to the shaft slot to provide passage of the bit rod along the slots and the enlarged end of the bit along the passages allowing the bit to be moved from a stored position in the bit pocket to a use position in the shaft recess.

* * * * *